US005881798A

United States Patent [19]

Luginbühl et al.

[11] Patent Number: 5,881,798

[45] Date of Patent: Mar. 16, 1999

[54] BLOCK ADJUSTMENT IN A CONTINUOUS CASTER

[75] Inventors: Erich Luginbühl, Sigriswil; Marcel Witschi, Thun; Ernst Zürcher, Reichenbach, all of Switzerland

[73] Assignee: Golden Aluminum Company, San Antonio, Tex.

[21] Appl. No.: 889,024

[22] Filed: Jul. 7, 1997

Related U.S. Application Data

[62] Division of Ser. No. 221,041, Mar. 30, 1994, Pat. No. 5,645,122.

[51] Int. Cl.[6] ..... B22D 11/06

[52] U.S. Cl. ..... 164/479; 164/430

[58] Field of Search ..... 164/479, 481, 164/430, 431, 137

[56] References Cited

U.S. PATENT DOCUMENTS

| | | | |
|---|---|---|---|
| 3,561,522 | 2/1971 | Bosold . | |
| 3,570,586 | 3/1971 | Lavener | 164/430 |
| 3,633,949 | 1/1972 | Pfluger | 287/20.3 |
| 4,784,210 | 11/1988 | Takahashi et al. | 164/479 |
| 4,794,978 | 1/1989 | Lavener | 164/431 |
| 4,854,371 | 8/1989 | Katahira et al. | 164/431 |
| 4,869,310 | 9/1989 | Yanagi et al. | 164/431 |
| 4,895,202 | 1/1990 | Sato et al. | 164/430 |
| 4,911,223 | 3/1990 | Sato et al. | 164/430 |
| 5,133,401 | 7/1992 | Cisko et al. | 164/430 |
| 5,290,121 | 3/1994 | Dolce et al. | 403/322 |
| 5,311,923 | 5/1994 | Cobes et al. | 164/430 |

FOREIGN PATENT DOCUMENTS

| | | | |
|---|---|---|---|
| 61-82954 | 4/1986 | Japan | 164/430 |
| 63-180349 | 7/1988 | Japan | 164/431 |
| 1-91942 | 4/1989 | Japan | 164/431 |

*Primary Examiner*—J. Reed Batten, Jr.
*Attorney, Agent, or Firm*—Sheridan Ross P.C.

[57] ABSTRACT

The physical position of a block assembly on a support beam in a continuous block caster is adjusted and maintained. In particular, the apparatus includes at least one device for adjusting and maintaining the physical position of the blocks in a beam chain.

50 Claims, 8 Drawing Sheets

BLOCK ADJUSTMENT IN A CONTINUOUS CASTER

This is a divisional of application Ser. No. 08/221,041, filed Mar. 30, 1994 and now U.S. Pat. No. 5,645,122, issued Jul. 8, 1997.

FIELD OF THE INVENTION

The present invention relates to a method and apparatus for fixation and adjustment of blocks in a continuous caster. In particular, the present invention relates to a method and apparatus for rapidly and reliably fixing blocks in position and reliably and accurately adjusting the position of the blocks in a continuous block caster.

BACKGROUND OF THE INVENTION

The continuous casting of molten metal into strips, sheets and slabs has been achieved through processes known as block casting. The term "metal" as used herein, refers to castable metal, including without limitation, aluminum, iron, steel, copper, zinc, manganese, magnesium, nickel and their alloys. Continuous block casters are particularly useful in the production of metal strip. Use of continuous block casters obviates the need to cast large ingots which must be repeatedly hot and cold rolled in order to obtain the desired thickness and microstructure of the cast. Moreover, it is easier to control the width of the strip being cast using continuous block casting methods than when using other processes to produce metal strip.

In a block casting process, metal is supplied from a tundish to a continuously moving mold assembly consisting of two endless, counter-rotating beam chains. An endless beam chain is comprised of, among other things, several "blocks" which have been linked together to form a casting loop, giving the chain assembly a caterpillar track appearance. The beam chains are disposed in close relation to one another and travel in synchronized fashion in the casting direction. The mold cavity can further be defined by a side dam system to prevent movement of the molten metal in a direction transverse to the casting direction. In other embodiments, the blocks themselves can contain features, such as sidewalls, which prevent escape of the molten metal. As the molten metal contacts the moving mold, heat transfer occurs between the blocks, the side dams (if any) and the molten metal, resulting in solidification of the molten metal.

In nearly all block casters, the blocks are attached to "support beam" structures. This structure assists in preventing heat transmission from the blocks and thermal deformations of the blocks from affecting the performance of other caster assemblies requiring relatively small operating tolerances, such as the guideway track and the drive system. For example, U.S. Pat. No. 3,570,586, by Lauener, assigned to Lauener Engineering Ltd., discloses a caterpillar mold-type casting apparatus for casting metal strips which uses bolts as a block fastening apparatus to preclude heat transfer by conductivity from the chilling blocks to the caster guideway and drive.

The blocks in a continuous caster also require periodic replacement due to wear on their casting surfaces. Moreover, the blocks experience wear from the thermal and physical stresses experienced in moving through the casting loop. This can result in cracked or deformed blocks, causing a reduction in the quality of the cast. In order to replace individual blocks in the beam chain, the continuous casting operation must be halted. The continual stopping of a continuous caster for replacement of blocks leads to undesirable down-time and a decrease in production. For example, in a typical block caster containing sixty-four blocks, all sixty-four blocks may need to be replaced in a four-to-six week period of continuous operation. It is therefore desirable that replacement of blocks in a continuous caster be accomplished quickly.

Apparatus which use bolts for block fixation typically do not allow for rapid replacement of individual blocks. Alternatively, U.S. Pat. No. 4,784,210 by Takahashi et al., assigned to Ishikawajima-Harima Jukogyo Kabushiki Kaisha and Nippon Kokan Kabushiki Kaisha, discloses a method for installing and replacing blocks in a continuous block caster. The apparatus disclosed by Takahashi et al. consists of a plurality of clamps connected to the carriers which clamp directly onto steps located on the sides of the blocks. Takahashi et al. also disclose that the clamps on either sides of the block are connected to biasing springs and can be retracted to remove the block from the track by using piston rods located on both sides of the block. The method disclosed by Takahashi et al. however, uses a substantial number of moving parts and does not allow single point operation for simultaneously releasing a plurality of block fixation devices. Moreover, the clamps used by Takahashi et al. directly contact the block, and after thermal loading of the block can lead to undesirable deformation of the block or the supporting structure.

In addition to block fixation methods and apparatus, it is also desirable to control the positioning of the individual blocks in the beam chain. The positioning required for the individual blocks can depend, among other things, upon the casting application. In general, however, the casting surfaces of each block, and between blocks in the casting region should approximate a flat plane. Thermal and mechanical deformations, however, can occur as the blocks travel through the casting loop. Moreover, for some applications blocks cannot be produced economically to the tolerances required for use in a caster. For these reasons, it is desirable that the positioning of individual blocks be adjustable.

There are essentially three types of adjustments that can be made to the block position in a continuous caster. It is desirable that the individual blocks be capable of being adjustable in the casting direction (the "x-direction"), in the direction transverse to the casting direction (the "y-direction"), and in the direction normal to the casting direction, (the "z-direction"). These adjustments assist in preventing undesirable gaps and "steps" between blocks in the casting region, which reduce the quality of the cast and can cause damage to the caster. The adjustments also assist in preventing premature block wear by preventing unnecessary contact between adjacent blocks as they travel through the casting region.

Known methods and apparatus for fixation and adjustment of blocks in a continuous caster have met with limited success for the rapid replacement of blocks. Typical methods for block adjustment can be unstable and unreliable, can require high adjustment forces, and cannot be performed with high precision. Thus, it is desirable to provide an adjustment method and apparatus which has positive control, is reliable and reproducible.

It is desirable that adjustments to the blocks can be performed quickly and with precision, using minimal adjustment forces. The adjustments should also be reliable and stable enough not to vary over long term operation of the caster. Movement of the blocks during casting can result in blocks unnecessarily contacting adjacent blocks. Moreover, the adjustments should prevent variation during casting in the block-to-block step between blocks, known as "block level drift." Block level drift during casting can result in the formation of insulating gas pockets, causing poor heat transfer between the block surfaces and the metal being cast.

SUMMARY OF THE INVENTION

In accordance with the present invention, methods and apparatus are provided for rapid, reliable fixation of blocks in a beam chain of a continuous caster. In accordance with the present invention, the methods and apparatus can also assist in decreasing caster down-time and the attendant loss in casting production. Such methods and apparatus of the present invention utilize a substantially small number of moving parts and can provide for single point operation for fixing and releasing blocks.

In accordance with the present invention, methods and apparatus are provided for adjustments to be performed to the blocks quickly, with precision, using substantially minimal adjustment forces. The present invention provides methods and apparatus for adjustment and maintenance of the position of the blocks in the x-direction, y-direction, and z-direction. The present invention provides methods and apparatus for making reliable and stable adjustments to the blocks in a beam chain. The present invention provides methods and apparatus for substantially preventing block level drift during casting, and can assist in preventing premature wear of the blocks. Moreover, the methods and apparatus of the present invention can assist in preventing damage to the continuous caster.

In accordance with the present invention, apparatus are provided for fixing a block assembly to a support beam in a beam chain of a continuous caster using a plurality of discreet fixing devices mounted on the block assembly and the support beam. Such plurality of discreet fixing devices can be capable of being actuated through application of force at a single point. The discreet fixing devices can be inserting and receiving apparatus, and more particularly can be pin apparatus and latch bolt apparatus. Actuation of the fixing devices can be, for example, by engagement of a latch apparatus with a pin apparatus, whereby the latch apparatus provides biasing forces upon the pin apparatus to secure a support beam to a block assembly.

In accordance with the present invention, apparatus are also provided for independently maintaining and adjusting the position of the blocks in the x-direction, the y-direction and the z-direction. More particularly, at least one fixing key apparatus can be provided for adjusting and maintaining the position of a block in the x-direction, at least one fixing key apparatus can be provided for adjusting and maintaining the position of a block in the y-direction, and at least one z-direction adjusting device can be provided for adjusting and maintaining the position of a block in the z-direction.

In accordance with the present invention, methods are provided for utilizing the block fixation and adjustment apparatus of the present invention.

DETAILED DESCRIPTION

Figure 1:
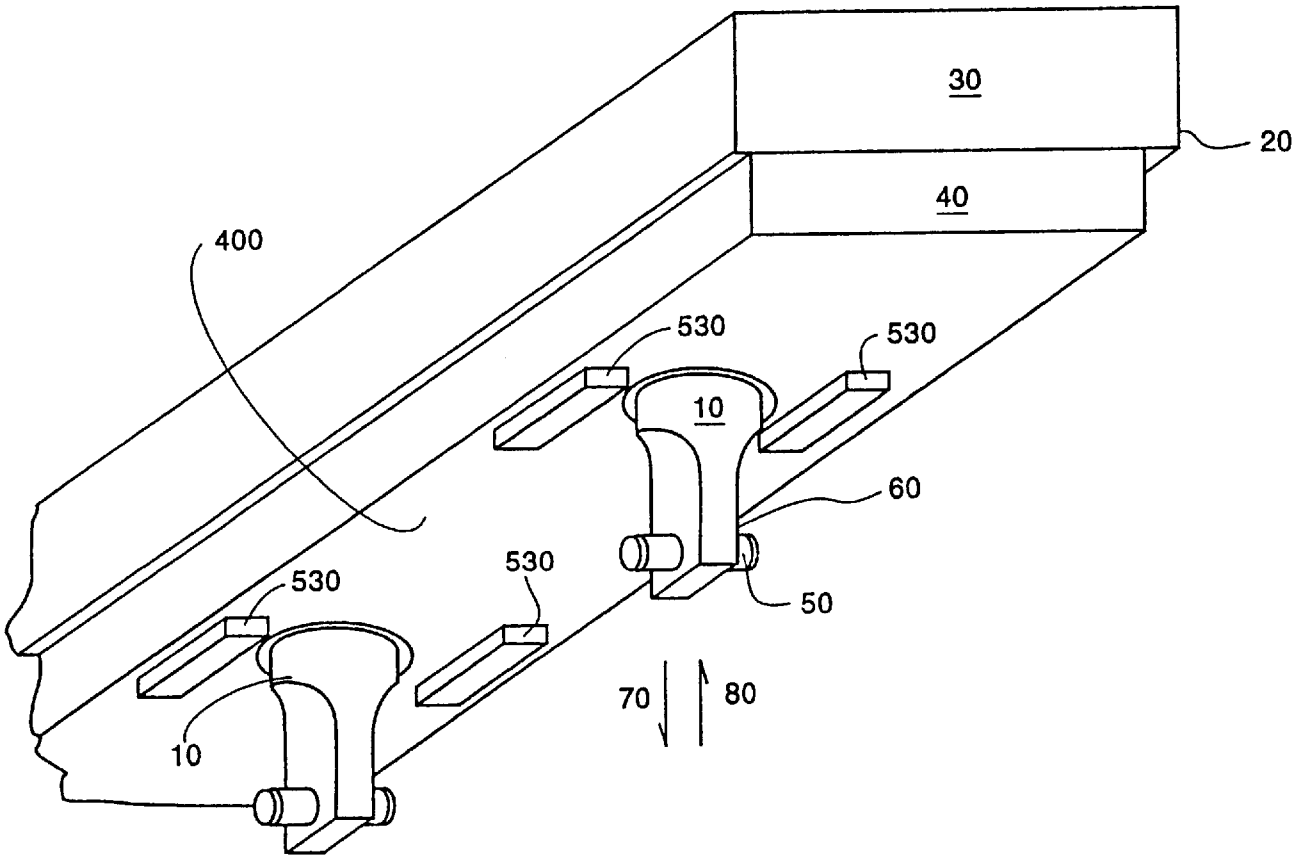
FIG. 1 is a perspective view of one embodiment of the present invention directed to inserting apparatus mounted on a block holding plate of a block assembly.

The present invention includes methods and apparatus for fixing blocks in place in a beam chain, and for adjusting and maintaining the position of the blocks. In particular, the apparatus of the present invention includes a fixing device for securing blocks in place in a beam chain, and devices for adjusting and maintaining the physical position of the blocks in the beam chain. The device for fixing blocks in the beam chain can include an inserting and receiving apparatus. Preferably, the device for fixing blocks in the beam chain can include a pin apparatus and a latch apparatus. Preferably, the devices for adjusting and maintaining block position can include devices for adjusting and maintaining block position in the x-direction, y-direction and z-direction.

The beam chain in a continuous block caster includes a number of blocks which can be attached to one or more block holding plates. The term "block assembly," as used herein, refers to both a block itself and a combination of a block mounted on one or more block holding plate assemblies. Because of the low tolerances which must be observed in the track guideway and drive system, it is preferred that the blocks be substantially thermally isolated from the rest of the caster, such as through the use of block holding plates. Typically, each block assembly in a beam chain can be further connected to one or more support beams for transporting the individual blocks through the casting loop via a track guideway and drive system. Adjacent support beams can be linked together to form an endless beam chain.

For fixing the block assemblies to the support beams, at least one, but preferably a plurality of inserting apparatus are placed along either the outward facing surface of a support beam, or on the surface opposite to the casting surface of a block assembly. It is preferred, however, that the inserting apparatus are placed on the surface opposite the casting surface of a block assembly, for example, mounted to one or more block holding plates. The number of inserting apparatus present on any one block assembly can depend, for example, upon the block assembly and support beam geometries and masses, and caster operational temperatures, however, in general, there will be at least 2 inserting apparatus for securing a support beam to a block assembly.

The inserting apparatus used to connect the block assemblies to the support beams can be designed to be engaged by a receiving apparatus. It is preferable, therefore, that the number of inserting apparatus corresponds to the number of receiving apparatus. The receiving apparatus can also be mounted on either a block assembly or on a support beam, however it is preferred that the receiving apparatus be mounted on support beams.

A block assembly should be capable of being fixed to a support beam by disposing the block assembly in close relation to a support beam, then applying a force to either the receiving or inserting apparatus such that the receiving apparatus engages the inserting apparatus. In a preferred embodiment of the present invention, operation of the fixing device can be achieved through application of a force to a single point, such as to a receiving apparatus such that at least some of a plurality of receiving and inserting apparatus can be engaged substantially simultaneously. As used herein, the term "single point", when used to describe an application of force or actuation, refers to application of force to a single apparatus or location or region of an apparatus. By engaging the receiving and inserting apparatus, the block assembly can be connected, and in some applications forcibly secured, to the support beam. In one embodiment, the block assembly can be connected to the support beam through biasing the receiving apparatus on the inserting apparatus. Preferably, the receiving apparatus is capable of multiplying the force placed upon it by an actuating force to create a tension in the inserting apparatus for securing the support beam to the block assembly.

For obtaining a satisfactory connection between the block assembly and the support beam, the actuating force applied to the receiving apparatus (i.e., in one embodiment, the longitudinal axis of the latch apparatus) for connection to the inserting apparatus can depend upon the number of receiving and inserting apparatus and the geometry of the support beam and block assembly. The actuating force applied to the receiving apparatus can be multiplied, such as by lever action, and transmitted to the inserting apparatus for connecting, and in some cases forcibly connecting, the support beam to the block assembly. The multiplied force holding the block assembly to the support beam can vary, for example, depending upon the number of receiving and inserting apparatus, the geometries and masses of the support beam and block assembly, the caster operational temperatures, and the spring used in the mounting of the inserting apparatus.

In one embodiment, the device for fixing block assemblies to support beams includes a inserting apparatus which can be at least one pin apparatus, and a corresponding number of receiving apparatus which can be latch apparatus. Preferably, the inserting apparatus includes a number of pin apparatus that are mounted along the surface opposite to the casting surface of the block assembly, i.e., on one or more block holding plates. One pin apparatus can be comprised of a bolt-like member attached to a block assembly at one end and having a cylindrical pin extending perpendicularly through its width at the other end. The bolt-like member can be attached to the block assembly using a spring-loaded design. In this design, a bolt-like member can be inserted and retained in a cavity on a block assembly. The bolt-like member can have a spring or similar device disposed around its circumference near the end of the bolt-like member which is attached to the block assembly. The spring can be retained on the bolt-like member by a lip on one end and a sheath surrounding the bolt. The spring-loaded design can allow movement of the bolt-like member by sliding the bolt through the sheath in a direction away from the block assembly to compress the spring creating tension in the bolt-like member. Alternatively, movement of the bolt-like member by sliding the bolt through the sheath in a direction towards the block assembly can decompress the spring. Thus, the spring loaded design can allow movement of the pin apparatus while it is being engaged and disengaged by the latching apparatus.

The pin apparatus can be designed to be inserted into a support beam and engaged by a receiving apparatus consisting of toggles located on a latch apparatus. The term "latch apparatus," as used herein, refers to a parallel plate and toggle assembly, wherein at least one toggle can be mounted between parallel plates, and such toggle can be capable of being rotated about an axis perpendicular to the longitudinal axis of the latch bolt and between the plates.

The toggles can be generally U-shaped, having two forks, and preferably are rotatably mounted to the parallel plates at the ends of such forks. A toggle can further contain curved, concave surfaces near the ends of each fork which are capable of engaging and rotating about the cylindrical pins extending from the sides of one end of the bolt-like member. The toggle can be placed in an orientation where application of a force to the plates of the latch apparatus cause the toggles to move toward and engage the cylindrical pins of a pin apparatus. Engaging the toggles with the pin apparatus can create tension in the bolt-like member as the spring in the pin apparatus is compressed, securing the block assembly to a support beam. After engaging the toggle with the pin apparatus, the bolt-like member can be disposed in the gap between the forks of the toggle.

Preferably, one latch apparatus contains a number of toggles, each corresponding to a number of pin apparatus projecting from a block assembly. The latch apparatus can be mounted on the support beam, such as by insertion of the parallel plates into channels machined into the support beam. The channels can be designed to substantially prevent movement of the latch apparatus in a direction normal to the support beam surface which contacts the block assembly. The channels, however, should also permit the latch apparatus to move substantially freely from side to side in the y-direction, in order to allow the toggles to engage the pin apparatus. Alternatively, the latch apparatus can be inserted into a groove in a support beam and held in place through the use of a plate mounted over such groove. Such a plate should also contain apertures through which the pin apparatus can be inserted for being engaged with the toggles of the latch apparatus.

For engaging the latch apparatus with the pin apparatus, the latch apparatus, which has a longitudinal axis in the y-direction, can be disposed in close relation to the pin apparatus on a block assembly after the block assembly is put in place in the beam chain. By applying a force to the longitudinal axis of the latch bolt, such as by the use of a screw, the toggles can be biased upon the pin apparatus. As the toggles are biased upon the pin apparatus, the force applied to the toggles can be transmitted, and multiplied by lever action of the toggles, to the pin apparatus. The force transmitted to the pin apparatus can compress the springs in the pin apparatus mounting can create tension in the pin apparatus. In this manner, the toggles and pin apparatus can connect, and in some cases forcibly secure the block assembly to the support beam. Furthermore, by adjustment of the springs in the pin apparatus mounting, one can increase or decrease the forces connecting a support beam and a block assembly.

Figure 2:
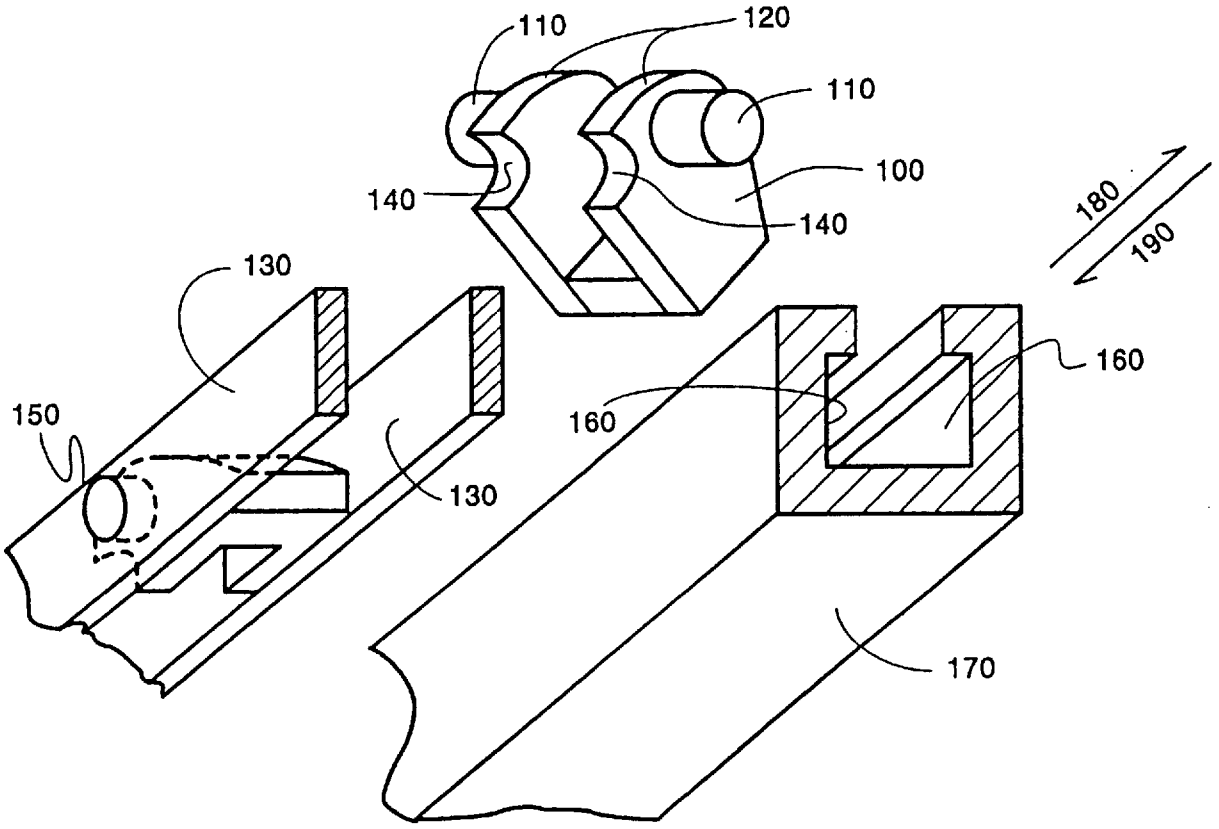
FIG. 2 is a perspective, disassembled view of one embodiment of the present invention directed to receiving apparatus mounted in a support beam.
Figure 3:
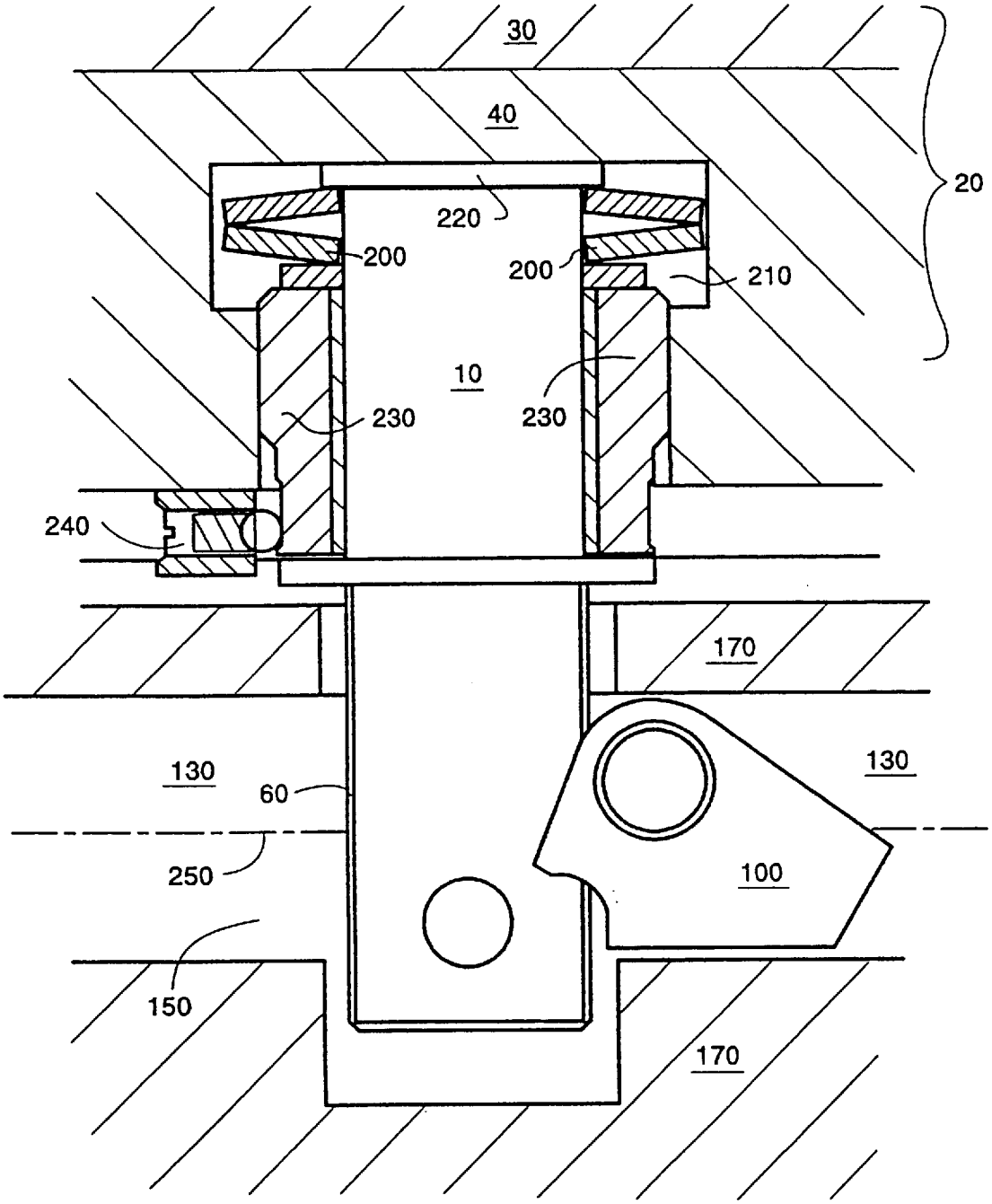
FIG. 3 is a cross-sectional illustration in the x-direction of one embodiment of the present invention directed to block fixation with the fixation device disengaged.
Figure 4:
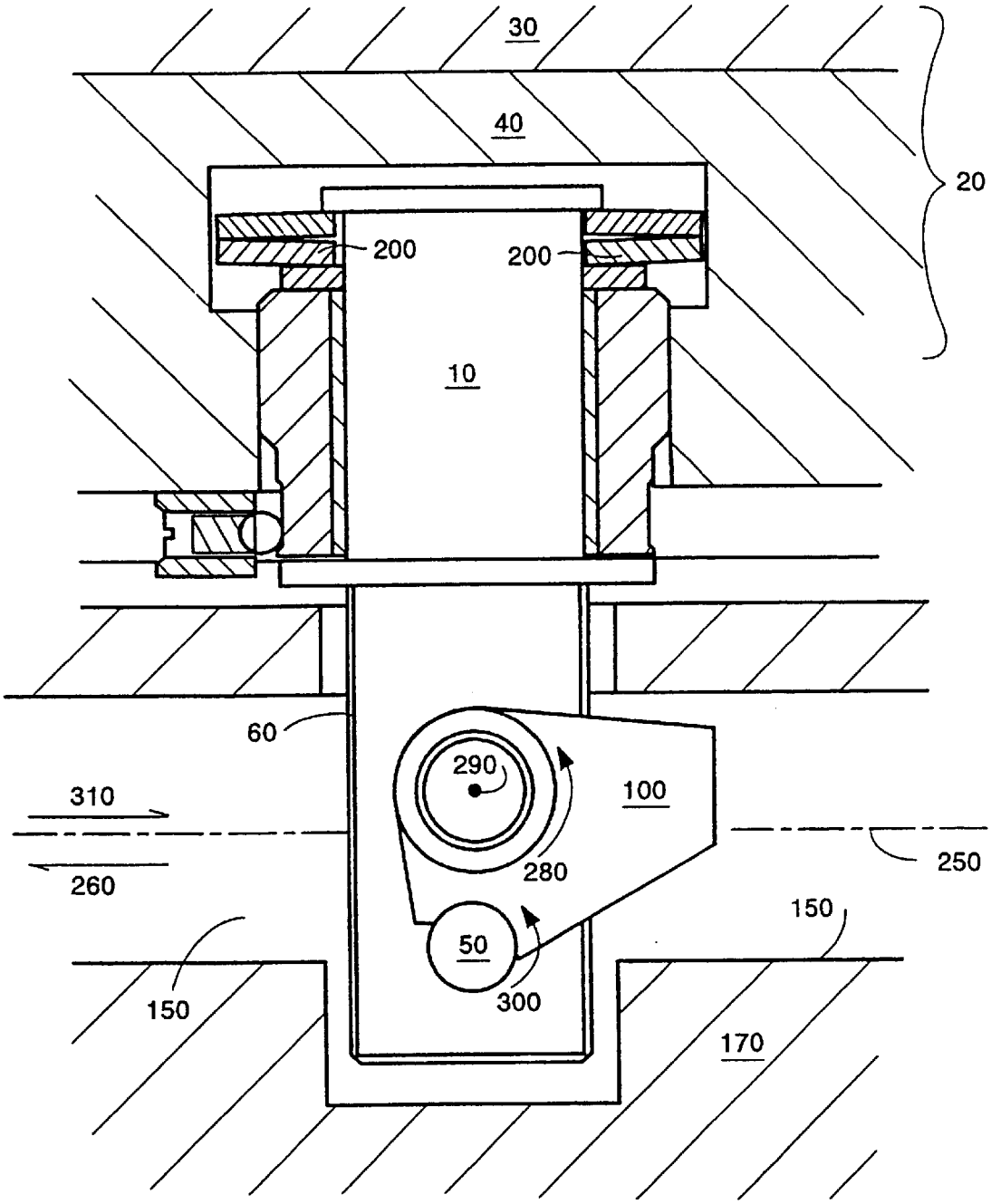
FIG. 4 is another cross-sectional illustration of the embodiment of the present invention illustrated in FIG. 3, with the fixation device engaged.

One can better understand the apparatus of the present invention by reference to FIGS. 1 through 5 and FIG. 7. FIG. 1 is a view of one embodiment of a pin apparatus projecting from a block assembly. FIG. 2 is a disassembled view of one embodiment of a latch apparatus and a support beam. FIGS. 3 and 4 are cut-away illustrations in the x-direction of one embodiment of a device for fixing blocks in a beam chain. In FIG. 3, the inserting and receiving apparatus of the fixing device are disengaged. In contrast, FIG. 4, shows a partial view of the fixing device showing the inserting and receiving apparatus of the fixing device in an engaged position.

Figure 5:
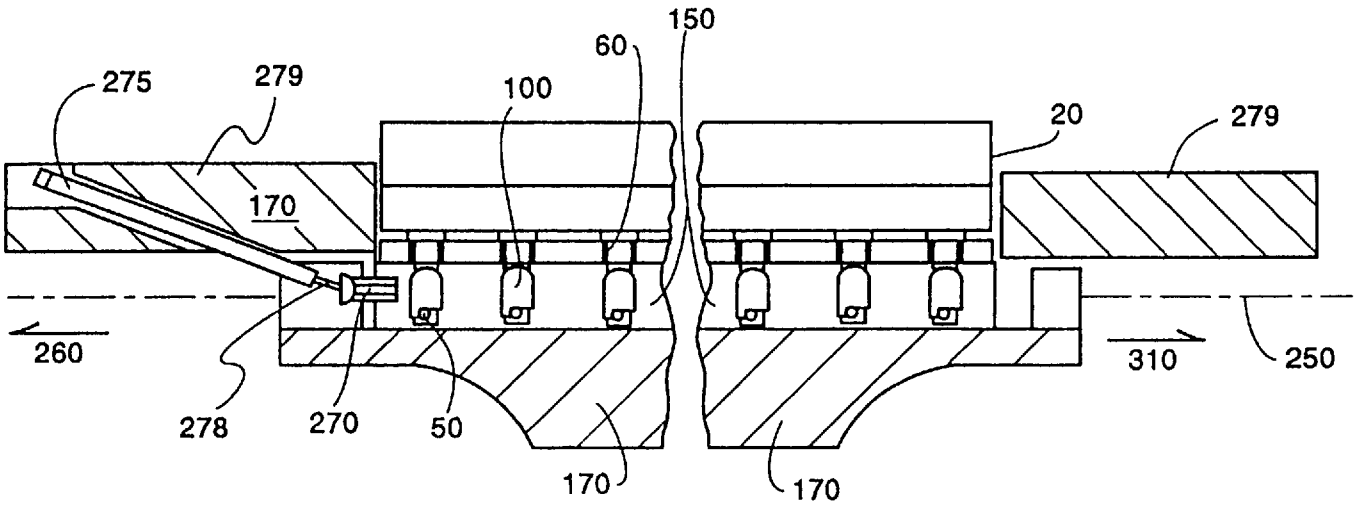
FIG. 5 is a cross-sectional illustration in the x-direction of one embodiment of the present invention showing the fixation of a block assembly to a support beam through the use of a plurality of discreet fixing devices.
Figure 7:
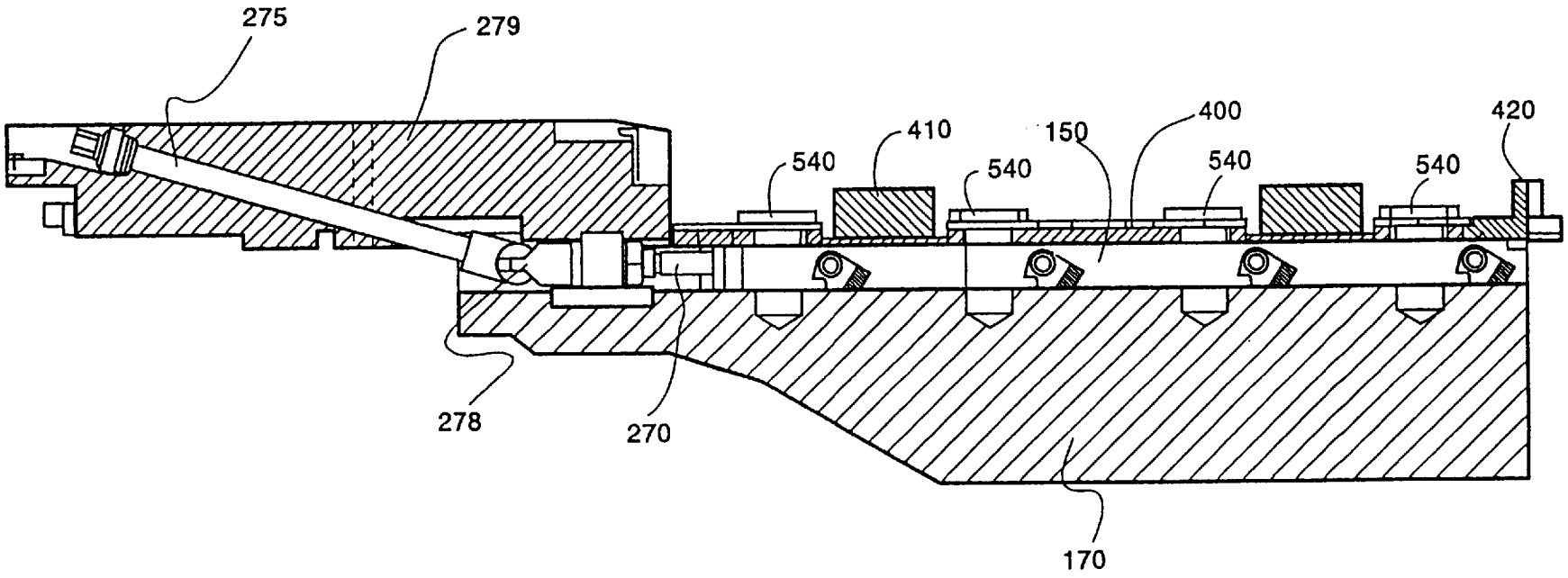
FIG. 7 is a cross-sectional illustration in the x-direction of one embodiment of the present invention directed to adjustment of block position.

FIG. 5 shows a cross sectional view in the x-direction of one embodiment of a plurality of inserting apparatus engaged by a plurality of receiving apparatus. FIG. 7 is a cross-sectional illustration in the x-direction of a support beam that is disengaged from a block assembly.

In FIG. 1, a spring-loaded bolt-like member 10 extends downward from a block assembly 20 consisting of a block 30 and a block holding plate 40. The bolt-like member 10 has a cylindrical pin 50 inserted through its width and extends from both its sides. The pin apparatus 60, comprised of the bolt-like member 10, the cylindrical pin 50, and a spring-loaded mounting (not shown) is capable of movement in both directions 70 and 80.

In FIG. 2, a U-shaped toggle 100 is shown having pins 110 extending from the ends of each fork 120 of the toggle 100 for rotatably mounting the toggle between two parallel plates 130. Each fork 120 contains curved, concave surfaces 140 for engaging the cylindrical pins 50 in FIG. 1. The plates 130, and the toggle 100 together comprise the latch apparatus 150. The latch apparatus 150 can be inserted into channels 160 machined into a support beam 170 shown here in cross-sectional view. The latch apparatus is capable of movement in both directions 180 and 190 for engaging and disengaging the pin apparatus 60 described in FIG. 1.

By reference to FIG. 3, one can see the block assembly 20, includes a block 30 mounted on a block holding plate 40 and a downward extending pin apparatus 60. Each pin apparatus 60 is mounted on the block assembly 20 using a spring-loaded design comprised of a spring 200 disposed around a bolt-like member 10. The spring 200 can be contained in chamber 210 and can be retained on the bolt-like member 10 by ridge 220 on bolt-like member 10 and sheath 230 surrounding bolt-like member 10. Bolt-like member 10 can be retained in the cavity 210 of the block holding plate 40 by threads on the sheath 230 and the block holding plate 40. At least one indexing element, such as screw 240, can be used to maintain position of the threaded sheath 230 to prevent it from loosening.

A support beam 170, is attached to a latch apparatus 150, which includes two parallel plates 130 (only one of which is shown) having a toggle 100 mounted between them. Latch apparatus 150 has a longitudinal axis 250 in the y-direction. By reference to FIGS. 4 and 5, one can see that when a force is applied along the latch apparatus longitudinal axis 250 in direction 260, the toggle 100 contacts pin apparatus 60. This application of force to the latch apparatus 150 can be accomplished, for example, as seen in FIGS. 5 and 7, by rotation of screw 270 by application of an actuating force to shaft 275 and universal joint 278 in support beam flange 279 of support beam 170. As shown in FIG. 4, further application of force along latch apparatus longitudinal axis 250 in direction 260, causes the toggle 100 to place a biasing force on the cylindrical pins 50, as the toggle 100 rotates in a counter-clockwise direction 280 along its axis in the x-direction 290, and in a counter-clockwise direction 300 along cylindrical pins 50 extending from bolt-like member 10. Such contact results in compression of spring 200 as a the force transmitted by the toggle 100 to cylindrical pins 50 creates tension in bolt-like member 10 of pin apparatus 60. The tension created in bolt-like member 10 increases with the lever action of the toggle 100 as the force along latch apparatus longitudinal axis 250 is continuously applied and until the latch apparatus and the pin apparatus are fully engaged, thereby connecting, and in some cases forcibly securing block assembly 20 to support beam 170. By application of a single actuating force to latch apparatus 150 in this manner, such as shown in FIG. 5, a plurality of pin apparatus 60 on a block assembly 20 can be substantially simultaneously engaged by a corresponding number of toggles 100 on a support beam 170.

By further reference to FIGS. 4 and 5, one can see that the latch apparatus 150 can be disengaged from the pin apparatus 60 to allow for rapid removal of block assembly 20 from the beam chain (not shown). To disengage the latch apparatus 150, a force is applied to the latch apparatus longitudinal axis 250 in direction 310. As a force is applied to the latch apparatus longitudinal axis 250, the toggles 100 mounted on the latch apparatus 150 rotate in a clockwise direction to reduce the tension in bolt-like member 10, decompressing spring 200 and allowing the toggles 100 to disengage from the cylindrical pins 50 of pin apparatus 60. The block assembly 20 can then be removed from the beam chain (not shown).

While a pin apparatus and a latch apparatus have been specifically mentioned, numerous variations of the described fixation device which can be rapidly and reliably inserted and disengaged can be used satisfactorily in the present invention.

The block assembly or the support beam can also contain one or more devices for adjusting and maintaining block position. During casting, thermal loading of the chilling blocks can cause deformations of the blocks, affecting the quality of the cast. To compensate for such deformations, it is preferred that an individual block's position be adjustable and maintainable using one or more block adjusting devices both prior to or after the block assembly has been secured to a support beam. Such devices can be used to adjust and maintain the position of the block in the direction of casting, (the "x-direction"), or in a direction transverse to the casting direction, (the "y-direction"). Furthermore, the block adjusting devices can allow adjustment of the block-to-block step between casting surfaces of blocks, (i.e. adjustment in the "z-direction").

For adjusting and fixing the position of the block in the x- and y-directions, the block adjusting device can include one or more fixing keys. The term "fixing keys" refers to plates which can be affixed to the block assembly or the support beam which have a key member which protrudes from the surface upon which the plate is mounted. A fixing key is typically mounted on a first surface, such as a surface of a block assembly or a support beam. A portion of the fixing key can protrude from this first surface for mating with a corresponding aperture or depression in a second surface, such as a surface of a block assembly or a support beam. In a preferred embodiment of the present invention, separate fixing keys for adjusting and maintaining block position independently in the x-direction and in the y-direction are affixed to a support beam. In such embodiment, the fixing keys can protrude from the surface of the support beam and can be capable of mating with the bottom surface of the block assembly to prevent movement of a block's position relative to the support beam during fixation and casting.

In one embodiment of the present invention, at least one x-direction fixing key is separate and independent from at least one y-direction fixing key. The portion of the x-direction fixing key that extends above the surface that it is mounted on can be rectangular in shape, however, any number of other shapes can be successfully employed. Nearly any number of fixing keys can be used on an individual block, however, typically the number of fixing keys used depends upon block geometry and weight. Adjustment of the position of the x-direction fixing key in the x-direction through use of adjusting tools, wedges and the like allows for control of the positioning of the block in the x-direction.

In one embodiment of the present invention, at least one y-direction fixing key is in contact with a block holding plate and a support beam such as for use in holding the block against movement caused by engagement of the fixing apparatus in the y-direction as the receiving and inserting apparatus are engaged. The y-fixing key can also be capable of adjusting the position of the block in the y-direction through the use of, for example, shims, wedges, adjusting screws or the like. In some applications, it is not necessary to adjust the position of a block assembly in the y-direction, especially if the casting surface of the chilling block does not contain features that must be substantially precisely aligned with features of adjacent or opposing chilling blocks, (i.e. sidewalls for preventing the escape of molten metal from the mold in the y-direction). The portion of the y-direction fixing key that extends above the surface that the key is mounted on is typically rectangular in shape, however, any number of other shapes can be successfully employed. In most embodiments, at least about 1 y-direction fixing key can be used for controlling movement of the block relative to the support beam during engagement of the receiving and inserting apparatus, however, additional y-direction fixing keys can be used if it is found that a single key is insufficient for preventing movement or to control positioning of the chilling block.

Figure 6:
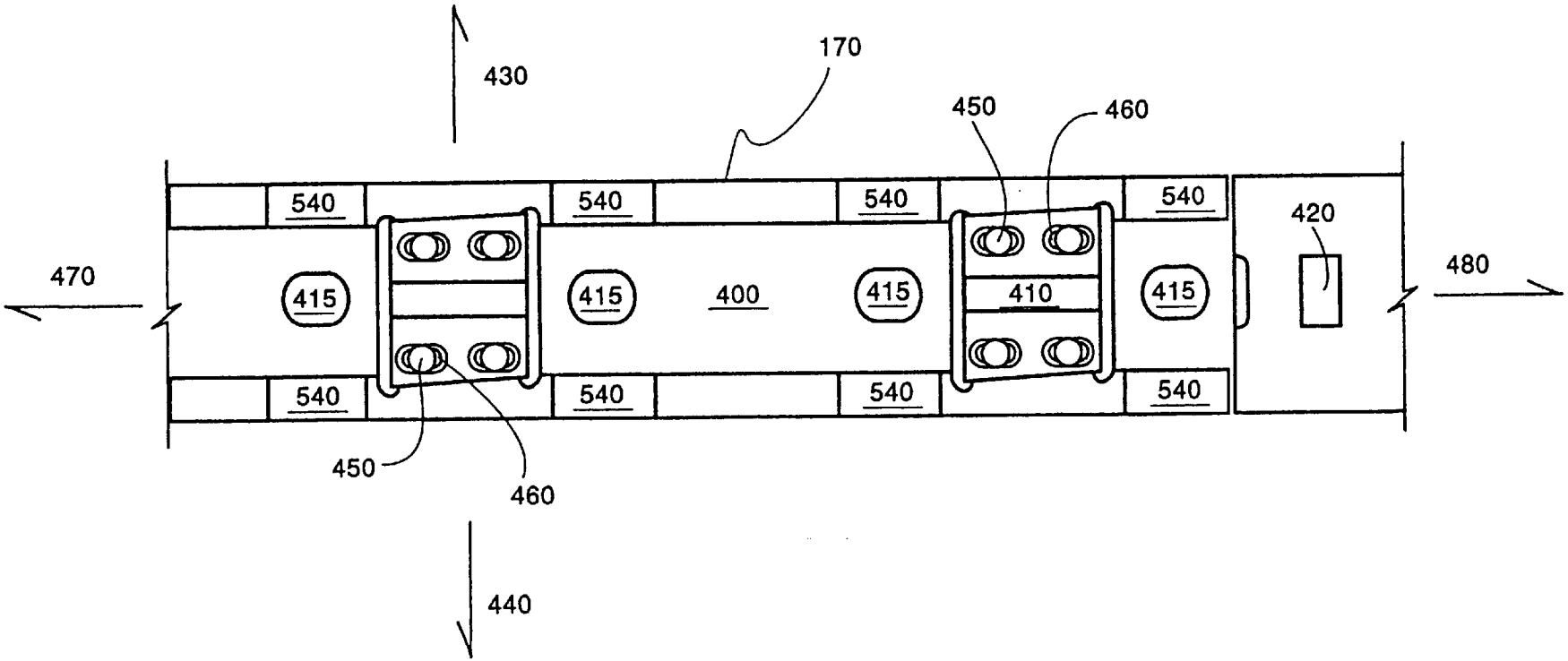
FIG. 6 is an illustration of one embodiment of the present invention directed to adjustment of block position.

One can more readily understand the adjusting devices of the present invention for adjustment and fixation of the block in the x- and y-directions by reference to FIGS. 6 and 7. FIG. 6 is an illustration of one embodiment of the x- and y-direction adjusting devices. In FIG. 6, looking down on a support beam 170 in the z-direction, one can see the surface of retaining plate 400 for retaining a latch apparatus (not shown) in a groove in support beam 170. Surface 400 of support beam 170 can include at least one rectangular x-fixing key 410 extending from the surface 400 and positioned between apertures 415 in surface 400 through which inserting apparatus can be placed during block fixation. Surface 400 also includes at least one rectangular y-fixing key 420 extending from surface 400 (also positioned between apertures 415 in surface 400). The portions of fixing keys 410 and 420 which protrude from surface 400 of support beam 170 can be seen in FIG. 7. As seen in FIG. 6, adjustment of the x-direction fixing keys 410 in directions 430 and 440 (the x-direction) can be accomplished by manipulation of adjusting screws 450, which have clearance in slots 460. In the embodiment shown in FIGS. 6 and 7, the position of y-direction fixing key 420 is fixed to prevent movement of the block assembly in directions 470 or 480, such as during engagement of the receiving and inserting apparatus of the fixing device. In other embodiments, however, the y-direction fixing key can contain bolts in slots similar to those used for the x-direction fixing key for adjusting position of the y-direction fixing key.

The position of the blocks can also be independently adjusted in the z-direction using one or more adjusting devices mounted on or in a block assembly or support beam, but preferably mounted in a block assembly. One embodiment of a z-direction adjusting device can include a dual-wedge assembly. The dual wedge assembly can include an "adjusting wedge" and a "level wedge." Both the adjusting wedge and the level wedge can be capable of contacting a support beam or a block assembly. It is preferred however, that the adjusting wedge be capable of contact with a block assembly and the level wedge be capable of contact with a support beam.

For changing position of the z-direction adjusting device, the inclined face of the adjusting wedge can be capable of bearing upon the inclined face of the level wedge. As the adjusting wedge is manipulated to bear upon the level wedge, the movement of the adjusting wedge along the inclined face of the level wedge can cause the wedges to contact the block assembly and the support beam. Thus, the dual wedge assembly can have three "contact zones," that is, the wedges can be in contact with one another and in contact with the block assembly and the support beam simultaneously. In this manner, manipulation of the adjusting wedge increases or decreases the distance between the block assembly and the support beam as the adjusting wedge and level wedge forces the support beam and block assembly apart or allows the support beam and block assembly to move closer together, effecting the position of the block in the z-direction. In a preferred embodiment, while the support beam and block assembly are engaged, the spring used in mounting the pin apparatus to a block assembly can be compressed or decompressed by adjusting the position of z-direction adjusting devices to allow movement of the support beam and block assembly relative to one another.

Nearly any number of z-direction adjusting devices can be used to adjust chilling block position in a beam chain. Typically, however, the number of z-direction adjusting devices used can be dependent, for example, upon block assembly and support beam geometries and masses, and caster operational temperatures. In a preferred embodiment, z-direction adjustment devices can be placed in a symmetrical arrangement on each side (about an axis in the y-direction) of an individual inserting apparatus.

In a preferred embodiment of the z-direction adjusting devices of the present invention, the adjusting wedge can include a screw-driven wedge, wherein the screw is disposed within the adjusting wedge such that a manipulation of the screw can change the location of the adjusting wedge along the longitudinal axis of the screw. Furthermore, if the adjusting wedge is a screw-driven wedge, an indexing element can be provided to prevent undesired movement of the screw beyond its desired position, thereby minimizing block level drift during casting. The indexing element can also be used to prevent the need to measure block height manually if the index is designed to increase or decrease block height in a known amount for each index position.

Figure 8:
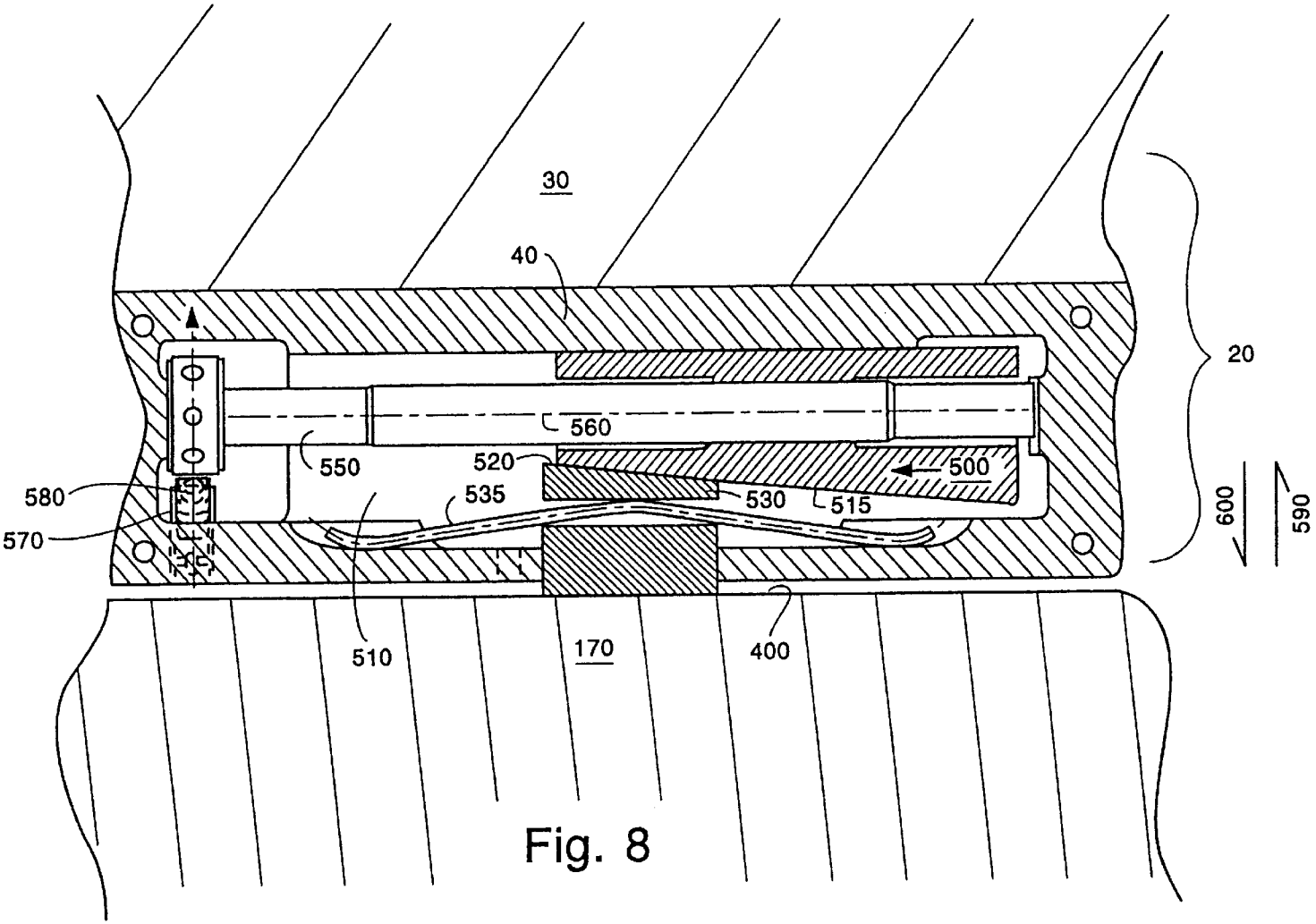
FIG. 8 is a cross-sectional illustration of another embodiment of the present invention directed to adjustment of block position in the z-direction.

The z-direction adjusting device can be more readily understood by reference, to one embodiment shown in FIGS. 1 and 6 through 8. FIG. 8 is a cross-sectional illustration of one embodiment of a z-direction adjusting device incorporating dual wedges mounted in a block holding plate of a block assembly. The screw-driven adjusting wedge 500 is disposed in a cavity 510 of a z-direction adjusting device mounted in a block holding plate 40 mounted on a chilling block 30. The inclined face 515 of the adjusting wedge 500 is in contact with the inclined face 520 of the level wedge 530. Plate spring 535, or a similar device, can be used to maintain contact between adjusting wedge 500 and the level wedge 530 when the block assembly 20 is removed from the support beam 170. The level wedge 530 is also in contact with a surface 400 of a support beam 170. In a preferred embodiment, as shown in FIGS. 6 and 7, level wedge 530 can be in contact with contact plates 540, mounted on surface 400 of support beam 170. Penetrating the adjusting wedge 500 is an adjusting screw 550 having a longitudinal axis 560. An indexing element 570 having an indexing ball apparatus 580 prevents the position of the chilling block 30 mounted on block holding plate 40 from being unintentionally altered (block level drift), such as by mechanical forces exerted on the block assembly during casting, and can allow for easy calculation of block height.

By rotation of the adjusting screw 550 in a clockwise or counter-clockwise direction, the adjusting wedge 500 can be forced to move along the longitudinal axis 560 of the adjusting screw 550. Movement of the adjusting wedge 500 along the longitudinal axis 560 of the adjusting screw 550 causes movement of the level wedge 530 in direction 590 towards or direction 600 away from block holding plate 40. As a result, level wedge 530 exerts or relieves pressure on the block support beam 170 and block holding plate 40, thereby manipulating the block-to-block step between adjacent blocks in a beam chain. In a preferred embodiment, movement of the level wedge 530 in FIG. 8 can change the relative positions of the block assembly 20 and support beam 170 by compression of spring 200 of pin apparatus 60 shown in FIGS. 3 and 4.

By reference to FIG. 1, one can see the location in one embodiment of the present invention of several z-direction adjusting devices in relation to pin apparatus 60 by the protrusion of level wedges 530 from the base of block holding plate 40 of block assembly 20.

The methods of the present invention are methods for using the block fixation and adjustment apparatus of the present invention. Such methods include providing a block assembly in close relation to a support beam and applying a force to a block fixation device to secure the block assembly to the support beam. The block fixation device can include, as previously described herein, inserting apparatus and receiving apparatus. In one embodiment, the method for fixing block assemblies to support beams can include actuating at a single point a plurality of receiving apparatus (or inserting apparatus) for substantially simultaneously engaging at least some of a corresponding plurality of inserting apparatus (or receiving apparatus) to secure the block assembly to the support beam.

In a preferred embodiment, the method of the present invention includes placing a block assembly including at least one pin apparatus in close relation to a support beam including at least one latch apparatus, then applying a force to the longitudinal axis of the latch apparatus to engage the pin apparatus such that the block assembly and the support beam are secured to one another. In a more preferred embodiment, the method of the present invention includes placing a block assembly including a number of pin apparatus in close relation to a latch apparatus including number of toggles corresponding to the number of pin apparatus, wherein a force is applied to the longitudinal axis of the latch apparatus, engaging the toggles with the pin apparatus, such that the toggles are biased upon the pin apparatus compressing a spring in the pin apparatus to create tension in the pin apparatus to secure the block assembly to the support beam.

The methods of the present invention also include the rapid removal of block assemblies from support beams in a beam chain. In particular, the methods of the present invention can include applying a force to the fixing device to disengage the block assembly from the support beam and removal of the disengaged block assembly from the beam chain. In one embodiment, the method of the present invention can further include applying a force to the receiving apparatus to disengage the receiving apparatus from the inserting apparatus, then removing the block assembly from the beam chain. In a preferred embodiment, the method of the present invention can include actuating at a single point a plurality of receiving apparatus (or inserting apparatus) for substantially simultaneously disengaging at least some of a corresponding plurality of inserting apparatus (or receiving apparatus) and removing the block assembly from the support beam.

The methods of the present invention also include independently adjusting and/or maintaining the position of blocks in the x-direction, y-direction or z-direction by manipulation of block adjusting devices. Moreover, the methods of the present invention can include fixing a block in a beam chain and adjusting the position of such block in the x-direction, y-direction and z-direction by manipulation of one or more fixing keys and one or more z-direction adjusting devices.

While various embodiments of the present invention have been described in detail, it is apparent that further modifications and adaptations of the invention will occur to those skilled in the art. However, it is to be expressly understood that such modifications and adaptations are within the spirit and scope of the present invention.

What is claimed is:

1. A method comprising:

a) securing a block assembly to a support beam in a beam chain of a continuous block caster, said block assembly having a z-direction adjusting device;

b) adjusting the position of said block assembly relative to said support beam in the z-direction.

2. The method as claimed in claim 1, wherein said step (b) of adjusting is performed after said block assembly has been secured to said support beam.

3. The method as claimed in claim 1, wherein said step (b) of adjusting is performed to compensate for deformations of said block assembly during casting.

4. The method as claimed in claim 1, wherein said z-direction adjusting device comprises a wedge means.

5. The method as claimed in claim 4, wherein said wedge means comprises an adjusting wedge and a level wedge.

6. The method as claimed in claim 5, wherein said adjusting wedge is capable of bearing upon said level wedge.

7. The method as claimed in claim 6, wherein said adjusting wedge comprises an adjusting screw for adjusting the position of said adjusting wedge.

8. The method as claimed in claim 7, wherein said adjusting screw comprises an indexing element.

9. An apparatus for use in adjusting and maintaining position of a block assembly to a support beam in a continuous block caster comprising:

(a) at least one fixing key secured to and protruding from a first surface;

(b) a second surface having depressions for accepting said fixing key protruding from said first surface; and wherein said fixing key is capable of being manipulated for altering the position of said block assembly relative to said support beam.

10. The apparatus as claimed in claim 9, wherein said first surface comprises a surface of said support beam.

11. The apparatus as claimed in claim 10, wherein said second surface comprises a surface of said block assembly.

12. The apparatus as claimed in claim 11, wherein said block assembly comprises a chilling block on at least one block holding plate.

13. The apparatus as claimed in claim 12, wherein said second surface comprises a surface of said block holding plate.

14. The apparatus as claimed in claim 11, wherein said at least one fixing key comprises at least one x-direction fixing key and at least one y-direction fixing key.

15. The apparatus as claimed in claim 9, wherein said first surface comprises a surface of said block assembly.

16. The apparatus as claimed in claim 15, wherein said second surface comprises a surface of said support beam.

17. The apparatus as claimed in claim 9, wherein said fixing key is secured using bolts.

18. The apparatus as claimed in claim 9, wherein said bolts are disposed in slots in said fixing key.

19. The apparatus as claimed in claim 9, wherein said fixing key is capable of being manipulated for altering the position of said block assembly in the x-direction.

20. The apparatus as claimed in claim 9, wherein said fixing key is capable of being manipulated for altering the position of said block assembly in the y-direction.

21. The apparatus as claimed in claim 9, wherein said fixing key is in fixed position.

22. The apparatus as claimed in claim 9, wherein said fixing key is capable of being manipulated after said block assembly has been secured to said support beam.

23. The apparatus as claimed in claim 22, wherein said fixing key is capable of being manipulated to compensate for deformations of said block assembly during casting.

24. An apparatus for controlling the position of a block assembly relative to a support beam in a continuous block caster, comprising:

(a) at least one wedge means in contact with a block assembly and a support beam;

(b) a means for adjusting said wedge means to alter the position of said block assembly relative to said support beam.

25. The apparatus as claimed in claim 24, wherein said wedge means is capable of being manipulated to alter the position of said block assembly in the z-direction.

26. The apparatus as claimed in claim 25, wherein said wedge means comprises an adjusting wedge and a level wedge.

27. The apparatus as claimed in claim 26, wherein said adjusting wedge is capable of bearing upon said level wedge.

28. The apparatus as claimed in claim 27, wherein said means for adjusting said wedge means comprises an adjusting screw for adjusting the position of said adjusting wedge.

29. The apparatus as claimed in claim 28, wherein said adjusting screw comprises an indexing element.

30. The apparatus as claimed in claim 24, wherein said wedge means comprises an adjusting wedge and a level wedge.

31. The apparatus as claimed in claim 30, wherein said wedge means is mounted in said block assembly.

32. The apparatus as claimed in claim 31, wherein said level wedge is in contact with said support beam.

33. The apparatus as claimed in claim 32, wherein said block assembly comprises a chilling block mounted on at least one block holding plate.

34. The apparatus as claimed in claim 30, wherein said wedge means is mounted on said support beam.

35. The apparatus as claimed in claim 34, wherein said block assembly comprises a chilling block mounted on at least one block holding plate, and wherein said level wedge is in contact with said block holding plate.

36. The apparatus as claimed in claim 35, wherein said means for adjusting said wedge means comprises an adjusting screw.

37. The apparatus as claimed in claim 24, wherein said wedge means is capable of being adjusted after said block assembly has been secured to said support beam.

38. The apparatus as claimed in claim 24, wherein said wedge means is capable of being adjusted to compensate for deformations of said block assembly during casting.

39. An apparatus for adjusting and maintaining position of a block assembly relative to a support beam in a continuous block caster, comprising:

(a) at least one fixing key comprising:

(i) a plate mounted to a first surface with bolts disposed in slots in said plate; and (ii) said plate having a protruding key member extending from said first surface and aligned with depressions in a second surface; and (b) a wedge means comprising:

(i) an adjustable wedge and a level wedge in contact with a support beam and a block assembly, wherein said adjustable wedge is capable of bearing upon said level wedge; and (ii) an adjusting screw for adjusting the position of said adjusting wedge relative to the position of said level wedge.

40. The apparatus as claimed in claim 39, wherein said fixing key is capable of being manipulated to adjust the position of said block assembly in the x-direction.

41. The apparatus as claimed in claim 39, wherein said fixing key is capable of being manipulated to adjust the position of said block assembly in the y-direction.

42. The apparatus as claimed in claim 39, wherein said wedge means is capable of being manipulated to adjust the position of said block assembly in the z-direction.

43. The apparatus as claimed in claim 39, wherein said first surface comprises the surface of a support beam.

44. The apparatus as claimed in claim 39, wherein said second surface comprises the surface of a block assembly.

45. The apparatus as claimed in claim 39, wherein said first surface comprises the surface of a block assembly.

46. The apparatus as claimed in claim 44, wherein said second surface comprises the surface of a support beam.

47. The apparatus as claimed in claim 39, wherein said wedge means is mounted in a block assembly.

48. The apparatus as claimed in claim 39, wherein said wedge means is mounted on a support beam.

49. The apparatus as claimed in claim 39, wherein said fixing key and said wedge means are capable of being adjusted after said block assembly has been secured to said support beam.

50. The apparatus as claimed in claim 39, wherein said fixing key and said wedge means are capable of being adjusted to compensate for deformations of said block assembly during casting.

* * * * *